United States Patent [19]

Taniguchi et al.

[11] Patent Number: 4,688,929

[45] Date of Patent: Aug. 25, 1987

[54] COMBINED ALARM DISPLAY AND NUMERICAL DISPLAY FOR ELECTROPHOTOGRAPHIC COPYING MACHINE

[75] Inventors: Akihiko Taniguchi, Kyoto; Haruyoshi Migita, Nara; Yasushi Nakanishi, Yamatokoriyama; Itsuro Kato, Kitakatsuragi, all of Japan

[73] Assignee: Sharp Kabushiki Kaisha, Osaka, Japan

[21] Appl. No.: 627,566

[22] Filed: Jul. 3, 1984

Related U.S. Application Data

[63] Continuation-in-part of Ser. No. 584,631, Feb. 29, 1984, abandoned.

[30] Foreign Application Priority Data

Jul. 12, 1983 [JP] Japan ..... 58-127395

[51] Int. Cl.[4] ..... G03G 15/00

[52] U.S. Cl. ..... 355/14 R; 355/14 SH; 340/715; 340/784; 340/286 M

[58] Field of Search ..... 355/14 C, 14 SH, 14 R; 364/410; 340/715, 784, 752, 756, 762, 524, 783, 525, 286 M; 368/241, 242

[56] References Cited

U.S. PATENT DOCUMENTS

| | | | |
|---|---|---|---|
| 4,163,230 | 7/1979 | Konii | 340/784 X |
| 4,176,941 | 12/1979 | Breitnkam et al. | 355/14 R |
| 4,184,319 | 1/1980 | Kumata | 368/241 X |
| 4,323,893 | 4/1982 | Ypsilantis et al. | 340/756 |
| 4,390,872 | 6/1983 | Murakami et al. | 340/784 X |
| 4,442,424 | 4/1984 | Shirasaki et al. | 340/715 |
| 4,458,243 | 7/1984 | Sado et al. | 340/756 |
| 4,475,806 | 10/1984 | Daughton et al. | 355/14 C X |
| 4,501,485 | 2/1985 | Tsudaka | 355/14 C X |
| 4,503,407 | 3/1985 | Ogura | 355/14 C |

*Primary Examiner*—Arthur T. Grimley
*Assistant Examiner*—J. Pendegrass
*Attorney, Agent, or Firm*—Birch, Stewart, Kolasch & Birch

[57] ABSTRACT

An electrophotographic copying machine includes a control circuit, a combined display responsive to the control circuit for showing the number of one or more copied papers, and the position of any paper jam or the operation condition. The combined display utilizes figure segments illuminated to form any figure, silhouette segments of the figure segments illuminated to provide a silhouette of the copying machine, and position marks illuminated to indicate the position of trouble in the machine and its operation conditions.

15 Claims, 6 Drawing Figures

Display
※1

S1
Paper Number Display ?
NO
YES
S4
Monitor
NO
TO ※A
YES
S5
Tray?
NO
YES
S6
Ō-ON
S7
Ō-OFF
S8
<Upper Cassette ?
NO
YES
S9
m-ON
S10
m-OFF
S2
h-q-OFF
S11
<Lower Cassette?
NO
YES
S12
n-ON
S13
n-OFF
S14
Upper Cassette Empty ?
NO
YES
S15
m.p-ON
S16
p-OFF
S17
Lower Cassette Empty ?
NO
YES
S18
n.q-ON
S19
q-OFF
TO ※B

COMBINED ALARM DISPLAY AND NUMERICAL DISPLAY FOR ELECTROPHOTOGRAPHIC COPYING MACHINE

This application is a continuation-in-part of application Ser. No. 584,631 filed on Feb. 29, 1984, now abandoned.

BACKGROUND OF THE INVENTION

The present invention relates to an electrophotographic copying machine and, more particularly, to a combined trouble alarm display and numerical display for an electrophotographic copying machine.

An electrophotographic copying machine produces an electrostatic latent image on a photoreceptor corresponding to a pattern image on a document such as a manuscript or book to be copied. Toner particles are electrostatically adhered to the latent image, so that the latent image becomes visible as a toner image. The toner image on the photoreceptor is transferred onto a copy paper via a transference charger.

Possibly, the copy paper may be jammed along its pathway. To indicate where the copy paper is jammed, an alarm display is conventionally provided which comprises a pathway display showing the travel pathway of the copy paper. When jamming of the copy paper occurs, the position of the trouble is specifically indicated by illuminating a lamp, a light emitting diode (LED), or the like, at an appropriate position in the alarm display.

However, the alarm display is additionally provided as being independent from a numerical display showing the copied paper numbers and the copy set number to be copied. Therefore, the operator may be confused in that, upon the occurrence of paper jam, he must look away from the numerical display and toward the alarm display because the operator is normally watching countdown of the numerical display to know the end of the copying operation.

SUMMARY OF THE INVENTION

Accordingly, it is an object of the present invention to provide an improved alarm display for an electrophotographic copying machine, showing the position of incurring trouble.

It is another object of the present invention to provide an improved combined alarm display and numerical display for an electrophotographic copying machine, the numerical display showing the number of a copy paper or papers to be copied and the alarm display showing the position of trouble incurred by the copy paper or papers, and the operation condition of the copying machine.

It is a further object of the present invention to provide an improved segment pattern of a combined alarm display and numerical display for an electrophotographic copying machine, such that segments of the alarm display are illuminated as being combined with segments of the numerical display to provide a silhouette of the copying machine.

Briefly described, in accordance with the present invention, an electrophotographic copying machine comprises a control circuit for operating the copying machine and a combined alarm display and numerical display, the numerical display showing the number of a copy paper or papers to be copied and the alarm display showing the position of trouble incurred, such as a jam of the copy paper or papers, and the operation condition of the copying machine. The operation condition indicates whether or not a paper exhaust tray is coupled to the copying machine, a paper cassette is coupled to a paper inlet of the copying machine, and empty paper cassettes. The numerical display comprises two-digit numerals, preferably, each including seven segments in a block eight formation. The alarm display comprises machine body silhouette segments, preferably, 13 segments including a combination of some of the fourteen total figure segments, and one or more position marks, preferably, four additional segments. The machine body silhouette segments are illuminated as being combined with some of the two-digit numerals of the numerical display to provide a silhouette of the copying machine. The one or more position marks are illuminated in combination with the silhouette segments to indicate the position of the trouble and the operation condition of the copying machine.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Throughout the drawings, like elements are indicated by like numerals.

Figure 1:
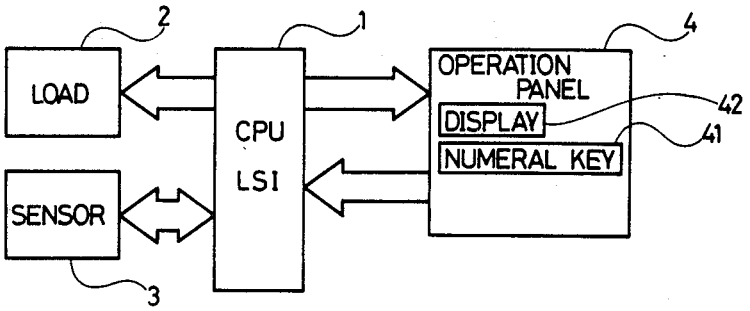
FIG. 1 is a block diagram of a circuit for activating a combined display in an electrophotographic copying machine according to the present invention.

FIG. 1 is a block diagram of a circuit of an electrophotographic copying machine according to the present invention. This circuit is provided for activating a combined alarm display and numerical display of the present invention.

The circuit of FIG. 1 comprises a central processing unit (CPU) 1, a group of loads 2, a group of sensors 3, and an operational panel including a combined display 42 and a numeral key switch 41.

The CPU 1 is provided for controlling the operation of the copying machine. Each of the group of loads 2 represents a load for discharge, light exposure, and developing operation all in the various components to cause the copying operation. The group of sensors 3 are provided for detecting the transport condition of a copy paper along the travel pathway to copy an image onto the copy paper. The group of sensors 3 detects the position of a photoreceptor for forming an electrostatic latent image. The operation panel 4 is manually operated by the operator to control the copying machine. The numeral key 41 is operated to set the number of the copy paper or papers to be copied. Responsive to the operation of the numeral key switch 41, the combined display 42 displays the number of one or more copied papers and the number of one or more copy papers to be copied. Additionally, the operation panel 4 includes a copy start switch, a copy density control switch, a monitor switch as will be described below, and the like. In accordance with the operation of the copy start switch, the CPU 1 is responsive to the detect conditions by the group of sensors 3 for subsequently controlling each load 2 and repeating the operation up to the copy number to be set.

Figure 2:
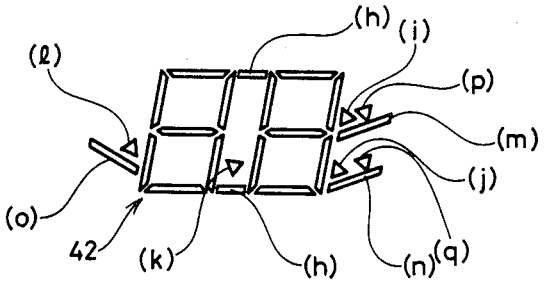
FIG. 2 is a segment pattern of the combined alarm display and numerical display according to the present invention.
Figure 3:
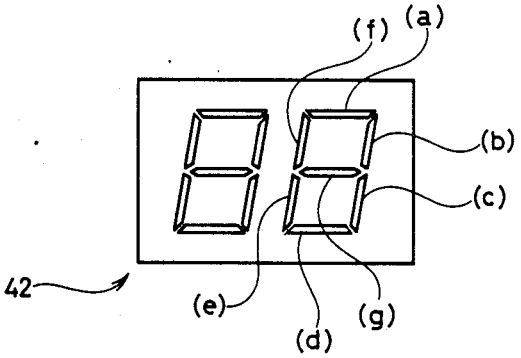
FIG. 3 is a segment pattern of a numerical display as included within the combined display of FIG. 2.

According to the present invention, the combined alarm display and numerical display 42 has a segment pattern as shown in FIG. 2. This segment pattern includes both the numeral display and the alarm display. FIG. 3 is a segment pattern of numerical display. The numerical display is, preferably, two figures, each preferably forming a block "eight" of seven segments (a) to (g) in which a numeral from "00" to "99" can be displayed by illuminating an appropriate combination of the segments. The number of the figures should not be limited to two. Any number of the figures can be selected.

To provide the alarm display, in addition to some segments of the two figures each having seven segments, some additional segments (h) to (q) are provided. These additional segments are provided for indicating the occurrence of any trouble such as a jam along the pathway of the copy paper and the operation condition of the copying machine. Two bar segments (h) are switched on for indicating the copy paper pathway silhouette in the copying machine in combination with some segments of the two figures. The two bar segments (h) are bridged between the upside- and the downside-corner segments of the two figures, respectively. A segment (m) is switched on for representing the shape of an upper paper cassette to be attached to an upper paper inlet of the copying machine. A segment (n) is switched on for representing the shape of a lower paper cassette to be attached to a lower paper inlet of the copying machine. The upper and the lower paper cassettes are coupled to the copying machine for supplying one or more copy papers. A segment (o) is switched on for representing the shape of a copied paper exhaust tray to be attached to a paper exhaust outlet of the copying machine. This exhaust tray is coupled to the copying machine for receiving one or more copied papers. The segments (n) and (o) are upwardly inclined with their ends being adjacent the downward corners of the two-numeral figures. The segment (m) is upwardly inclined with its end being adjacent the minus figure segment at the middle of the figure.

To alarm the position of trouble such as the jam of the copy paper, position marks (i), (j), (k), and (l), preferably, four are provided above the respective bar segments. In comply with the positions of the group of sensors 3, the position marks (i) to (l) are positioned.

Additionally, each of paper empty marks (p) and (q) may be illuminated to indicate that each of the upper and the lower paper cassetters attached to the copying machine are empty.

Figure 4:
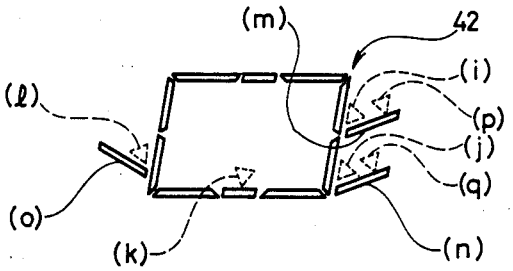
FIG. 4 is a segment pattern of an alarm display as included within the combined display of FIG. 2.

FIG. 4 is a segment pattern of the alarm display as included within the combined display showing a silhouette of the copying machine. The silhouette pattern of FIG. 4 is formed by illuminating the five bar segments (h), (m), (n), and (o), the (a) to (d) segments in the right-most figure, and the (a) and (d)–(f) segments of the left-most figure.

Figure 5:
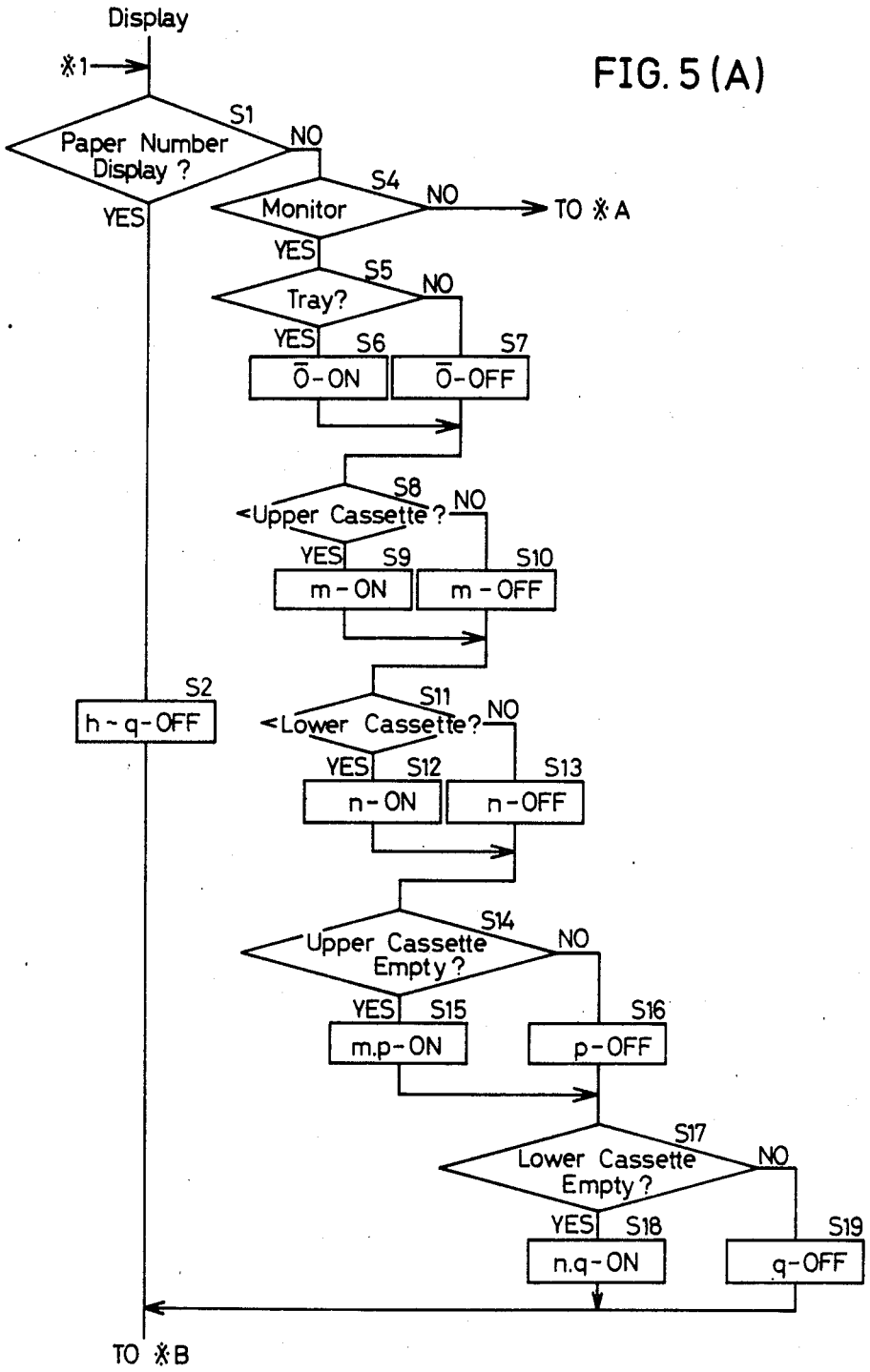
FIGS. 5(A) and 5(B) are flow charts of the operation of the copying machine according to the present invention.
Figure 5B:
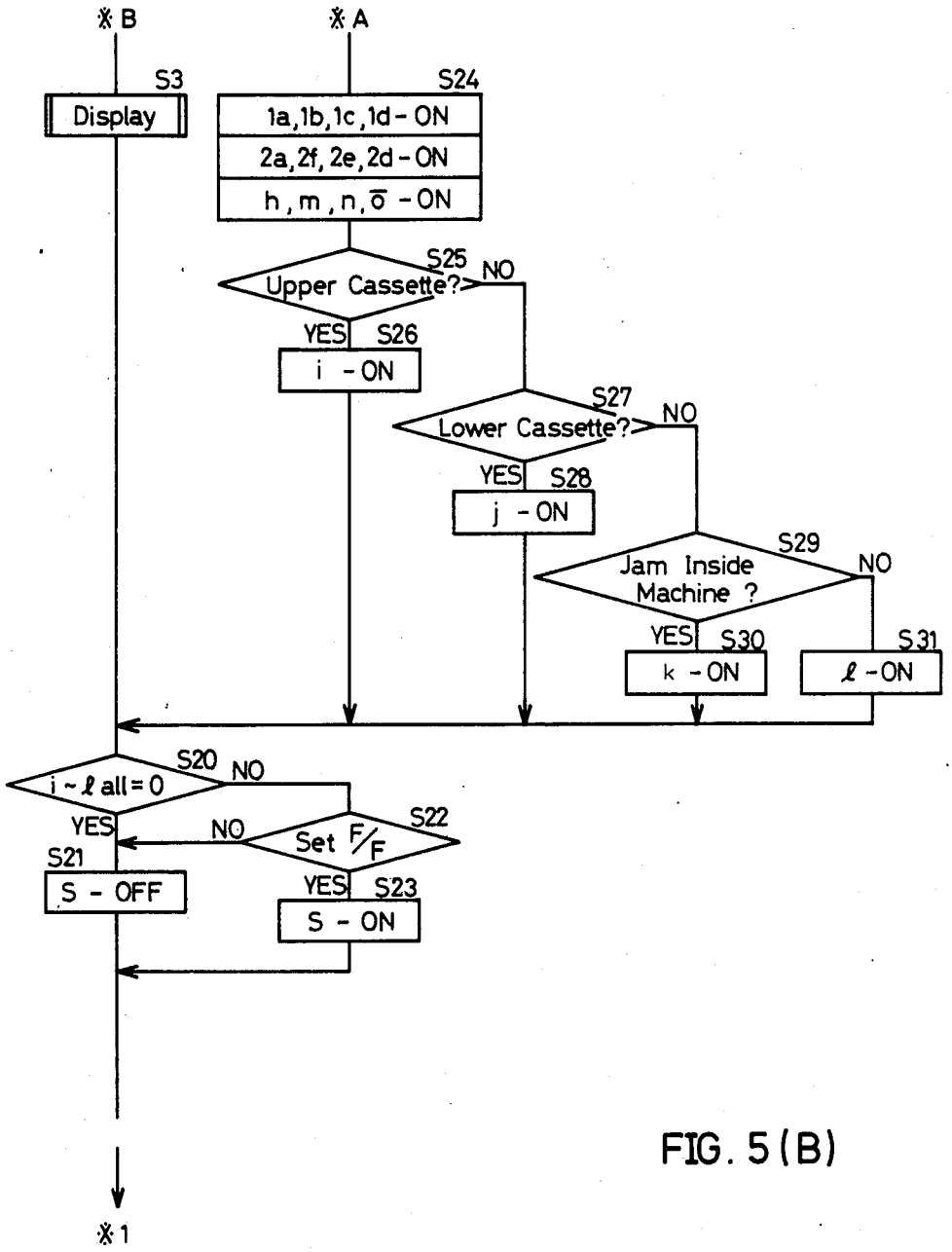

FIGS. 5(A) and 5(B) are flow charts of the operation of the combined display according to the present invention.

While the copying machine is in proper operation, the numeral key switch 41 is actuated to set and input the desired number of one or more copies to be copied, so that the CPU 1 enables the combined display 42 to display the set copy number using the numerical display as shown in FIG. 3. Referring to FIGS. 5(A) and 5(B), the following steps are conducted:

S1: It is detected whether the copy paper number is displayed.

S2: The segments (h) to (q) showing a silhouette of the copying machine are all switched off.

S3: The inputted copy number is displayed by selectively switching on the segments (a) to (g) of the two figures.

An operation condition monitor mode can be selected in the copying machine in which there are monitored the operation condition of the copying machine such as the attachment of the exhaust tray and either the upper or the lower paper cassette to the copying machine, and the emptiness of either the upper or the lower paper cassettes.

S4: In response to the actuation of a monitor switch for selecting this operation condition monitor mode, following step S1, step S4 is selected to detect whether this monitor mode is selected.

S5: This step is selected to detect whether the exhaust tray is attached to the copying machine.

S6: With the exhaust tray attached to the copying machine, the segment (o) is switched on.

S7: With the exhaust tray not attached to the copying machine, the segment (O) is switched off.

S8: It is detected whether the paper cassette is attached to the upper paper inlet of the copying machine.

S11: It is detected whether the paper cassette is attached to the lower paper inlet of the copying machine.

S9, S10, S12 and S13: Depending on the attachment of either the upper or the lower paper cassette, the segments (m) and (n) are selectively switched on and off.

S14 and S17: It is detected in step S14 whether the upper paper cassette attached to the copying machine is empty or not. Also, it is detected in step S17 whether the lower paper cassette is empty or not.

S16 and S19: When the paper cassette has at least one copy paper and is not empty, the segment (p) (step S16) and the segment (q) (step S19) are switched off.

S15 and S18: When the paper cassette is empty, the segments (m) and (p) (step S15) and the ones (n) and (q) (step S18) are switched on.

S3: Following these steps, step S3 is selected in which all the switched-on segments are switched on again for confimation. Then, the silhouette display of FIG. 4 is provided. In addition to the total silhouette of the copying machine, the attachment of the upper and the lower paper cassettes to the copying machine and the provision of at least one copy paper in either cassette are represented and indicated. It is also indicated whether the paper exhaust tray is attached to the copying machine. If either of the segments (p) and (q) are switched on, it is indicated that the relevant paper cassette is empty.

S20: It is detected whether the segments (i), (j), (k) and (l) for the trouble display are switched on or off. However, in the monitor mode and the copy number display mode, these segments are all switched off, so that via step S21, step S1 is reselected to detect whether the combined display 42 should display the copy number or not. In such a case, when the copy number is not inputted, the display in the operation condition monitor mode is maintained. If the copy number is inputted during the display of the operation condition monitor mode, the combined display 42 is operated to display the inputted copy number.

To start the operation condition monitor mode, the monitor switch is operated. It may be evident that the monitor switch can be eliminated and, in response to the termination of copying the set copy number, the monitor display of FIG. 4 is automatically enabled. Further, it may be possible that the emptiness of the copy paper in the paper cassette used for the copying operation enables the monitor display of FIG. 4 to be automatically selected and displayed. For this purpose, after step S1 is selected in which the signal representative of the emptiness of the paper cassette is generated by the sensor, step S4 is selected in which it is detected whether the upper or the lower paper cassette is empty or not, in order to switch on the segments (p) and (q).

When a paper jam is incurred during the copying operation of the copying machine, a jam alarm mode is selected and conducted as follows:

S1-S4-S24: In response to the detection of a jam, a signal representative of this condition is generated by which steps S1-S4-S24 are advanced. The silhouette of the copying machine emerges by illuminating the segments (a), (b), (c), and (d) of the right-most figure and the segments (a), (f), (e), and (d) of the left most figure, and the additional segments (h), (m), (n), and (o) as shown in the display of FIG. 4.

S25: It is detected whether the jam is incurred with a copy paper inserted from and positioned just by the upper paper cassette.

S26: If the upper paper cassette is detected as being jammed, the segment (i) is switched on.

S27: It is detected whether the jam is incurred by a copy paper inserted from and positioned just by the lower paper cassette.

S28: If the lower paper cassette is detected as being jammed, the segment (j) is switched on.

S29: It is detected whether the jam is incurred by a copy paper positioned inside the copying machine.

S31: When the jam is incurred by a copy paper positioned adjacent the paper exhaust tray, the segment (l) is switched on with switching off the remaining segments (i), (j), and (k).

S20-S22: The segment (l) representative of the jam portion is flickered. It is detected whether a flip-flop for flickering is set or not. This flip-flop is cyclically set and reset in a predetermined cycle.

S23: When the flip-flop is set, step S23 is selected so that a signal S is generated and outputted as referred to as "on" in the flow chart. Responsive to the signal S, the segment (l) is switched on. If the signal S is not generated as referred to as "off" in the flow chart, the segments (i), (j), (k), and (l) are switched off.

To set and reset the flip-flop in the cycle, a trigger signal generator may be provided for inputting a trigger signal into the flip-flop in the cycle.

S22: After the segment (l) is switched on, step S22 is selected.

S21: When the flip-flop is reset, step S21 is selected in which the signal S is not generated and is "off". Then, the segment (l) is turned off.

By repeating these steps, the segments (i), (j), (k), and (l) for the trouble position display are flickered in accordance with the conversion cycle of the flip-flop.

Preferably, in the combined display 42, some or every segment comprises a light emitting diode (LED). Further, the illumination color of the trouble position marks (i) to (l) is selected to be red while the illumination color of the figure segments (a) to (g) and the additional bar segments (h), (m), (n), and (o) are selected to be green, to clearly differ the trouble position from the silhouette of the pathway in the copying machine. It may be possible that some or every segment is provided with a monochromatic, preferably, a color liquid crystal display.

It is preferable that the color of the segments (p) and (q) for the cassette emptiness indication is different from that of the silhouette segments and the segments (p) and (q) which are flickered. Also, without the attachment of the cassette to the copying machine, the segments (m) and (n), and, without the attachment of the paper exhaust tray, the segment (o) may be flickered.

Further, according to the present invention, it may be possible to alarm the need for the following maintenance requirements the supply of a developing agent, the exchange of a photoreceptor, and the damage of the group of sensors 3. If necessary, any symbolic figures of these maintenance needs are provided in the combined display 42 by adding some additional segments.

According to the present invention, the combined display 42 is provided for serving as the numerical display and the alarm display. It is unnecessary for the operator to look from the numerical display to the alarm display upon the occurrence of the copy paper jam and the monitor display of the operation conditions of the copying machine.

While only certain embodiments of the present invention have been described, it will be apparent to those skilled in the art that various changes and modifications may be made therein without departing from the spirit and scope of the present invention as claimed.

What is claimed is:

1. An electrophotographic copying machine, comprising:

numerical display means for displaying a number of copies to be made, said numerical display means including at least two numerical figures of a block-eight formation, each of said figures including seven display segments; and alarm display means for schematically indicating the occurrence and location of trouble within the copying machine, said alarm display means including at least some of said numerical display segments of said numerical display means and a plurality of additional display segments.

2. A copying machine according to claim 1, wherein said alarm display means further includes a plurality of trouble markers.

3. A copying machine according to claim 1, wherein said display segments of said numerical display means included in said alarm display means schematically represent at least a part of said copying machine.

4. A copying machine according to claim 3, further including control means for selectively illuminating said numerical display segments and said additional display segments.

5. A copying machine according to claim 1, further including means for indicating the operation condition of said copying machine, said operation condition representing the attachment of a copy paper cassette and a copied paper reception tray to said copying machine, and an empty condition in said attached paper cassette.

6. The copying machine according to claim 1, further including means for cyclically flickering said alarm display means to indicate the occurrence of an abnormal condition in connection with said copying machine.

7. In an apparatus, a display for displaying numerical information and disparate pictorial information relating to a condition of said apparatus, comprising:

at least one segmented numerical display for displaying said numerical information including a plurality of display segments; and schematic pictoral information display means for schematically displaying the condition of said apparatus, said schematic display means including a plurality of additional display segments;

said plurality of display segments including at least some dual function display segments;

said schematic pictoral information display means utilizing said dual function display segments and said additional display segments to schematically display at least a portion of said apparatus.

8. A display according to claim 7, wherein said apparatus is an electrophotographic copying machine.

9. A display according to claim 7, wherein said at least one segmented numerical display is a block-eight formation having seven discrete display segments.

10. A display according to claim 7, wherein said at least a portion of said apparatus is a silhouette of an electrophotographic copying machine.

11. A display according to claim 7, further including control means for selectively illuminating at least some of said plurality of display segments and said additional display segments for schematically displaying the condition of said apparatus.

12. The display according to claim 7, further including trouble markers to indicate the location of trouble in said apparatus on said schematic pictoral information display means.

13. An electrophotographic copying machine, comprising:

numerical display means for displaying a number of copies to be made, said numerical display means including at least two numerical figures of a block-eight formation, each of said numerical figures including seven display segments;

alarm display means for indicating a position within the copying machine which requires maintenance, said alarm display means including at least some display segments of said numerical display means and a plurality of additional display segments superimposed on said numerical display means;

means for selectively illuminating said numerical display means or said alarm means; and control means, responsive to the detection of said maintenance requirements, for selectively illuminating at least a portion of said numerical display means to form a silhouette of said copying machine, said plurality of additional display segments being illuminated in combination with the silhouette to indicate the position within the copying machine which requires maintenance.

14. A copying machine according to claim 13, wherein the positions within the copying machine which require maintenance include positions related to a copy paper jam along the copy paper path, a low supply of developing agent, empty paper trays, a faulty photoreceptor, and damage to copy paper path sensors.

15. A copying machine according to claim 13, wherein said means for selectively illuminating said alarm means illuminates said at least two numerical figures of a block-eight formation in green and illuminates said additional display segments superimposed on said numerical display segments in red to visually differentiate between a maintenance requirement and a trouble-free copying operation within said copying machine.

* * * * *